US009765442B2

(12) United States Patent
Weng et al.

(10) Patent No.: US 9,765,442 B2
(45) Date of Patent: Sep. 19, 2017

(54) ELECTROLYTE FOR SURFACE TREATMENT OF METAL IMPLANT AND METHOD FOR SURFACE TREATMENT OF METAL IMPLANT USING SAID ELECTROLYTE

(71) Applicant: METAL INDUSTRIES RESEARCH & DEVELOPMENT CENTRE, Kaohsiung (TW)

(72) Inventors: Li-Wen Weng, Kaohsiung (TW); Chun-Chieh Tseng, Kaohsiung (TW); Yue-Jun Wang, Kaohsiung (TW); Ho-Chung Fu, Kaohsiung (TW); Tzyy-Ker Sue, Kaohsiung (TW)

(73) Assignee: Metal Industries Research & Development Centre, Kaohsiung (TW)

( * ) Notice: Subject to any disclaimer, the term of this patent is extended or adjusted under 35 U.S.C. 154(b) by 134 days.

(21) Appl. No.: 14/967,424

(22) Filed: Dec. 14, 2015

(65) Prior Publication Data

US 2017/0167043 A1 Jun. 15, 2017

(51) Int. Cl.

| | |
|---|---|
| ***C25D 11/08*** | (2006.01) |
| ***C25D 11/16*** | (2006.01) |
| ***C25D 11/24*** | (2006.01) |

(52) U.S. Cl.

CPC ..... *C25D 11/08* (2013.01); *C25D 11/16* (2013.01); *C25D 11/24* (2013.01)

(58) Field of Classification Search

None

See application file for complete search history.

(56) References Cited

U.S. PATENT DOCUMENTS

2005/0181330 A1* 8/2005 Kim ..... A61C 8/0069 433/173

FOREIGN PATENT DOCUMENTS

| | | | |
|---|---|---|---|
| CN | 1772967 | A | 5/2006 |
| TW | 201402871 | A | 1/2014 |
| TW | I435955 | B | 5/2014 |

* cited by examiner

*Primary Examiner* — Kishor Mayekar

(74) *Attorney, Agent, or Firm* — Alan D. Kamrath; Kamrath IP Lawfirm, P.A.

(57) ABSTRACT

An electrolyte for surface treatment of a metal implant includes 10-30 wt % of a sulfur-containing compound aqueous solution, 3-10 wt % of a phosphorous-containing compound aqueous solution, 0.5-2 wt % of an oxidant aqueous solution, and 0.5-5 wt % of a surfactant aqueous solution, with the rest being water. The concentration of the sulfur-containing compound aqueous solution is 0.1-3 M. The concentration of the phosphorous-containing compound aqueous solution is 0.05-2 M. The concentration of the oxidant aqueous solution is 0.05-1 M. The concentration of the surfactant aqueous solution is 0.05-5 M. The electrolyte is utilized for treating a surface of a metal implant, forming a porous oxide layer on the surface of the metal implant.

5 Claims, 3 Drawing Sheets

ELECTROLYTE FOR SURFACE TREATMENT OF METAL IMPLANT AND METHOD FOR SURFACE TREATMENT OF METAL IMPLANT USING SAID ELECTROLYTE

BACKGROUND OF THE INVENTION

1. Field of the Invention

The present invention generally relates to an electrolyte and, more particularly, to an electrolyte for surface treatment of a metal implant, and a method for surface treatment of a metal implant using said electrolyte.

2. Description of the Related Art

Metal implant is a type of medical implants, and is widely used in human hard tissues, such as teeth, bones and joints, for enhancing or fixing purposes. Normally, a porous oxide layer must be formed on a surface of a metal implant through surface treatment, such that the metal implant forms an intimate bond with human hard tissues after implanting. Thus, disengagement of the metal implant is prevented.

A conventional electrolyte for surface treatment of a metal implant includes a sulfur-containing compound, a phosphorous-containing compound, an oxidant and water. Besides, a conventional method for surface treatment of a metal implant includes immersing the metal implant in the electrolyte, and forming said porous oxide layer on the surface of the metal implant through micro-arc discharge reaction. Such an electrolyte and method for surface treatment of a metal implant can be seen in Taiwan Patent No. 1435955.

However, during the process of micro-arc discharging, reaction gas, such as hydrogen gas, may be generated. In the case that apertures or tunnels has already formed on the surface of the metal plant, reaction gas may easily adhere to the surface of the metal implant, thus adversely affecting formation of the porous oxide layer. Hence, the porous oxide layer cannot be formed.

According to the above, the conventional electrolyte and method for surface treatment of the metal implant might not be suitable for such a metal implant having apertures or tunnels.

SUMMARY OF THE INVENTION

It is therefore the objective of this invention to provide an electrolyte for surface treatment of a metal implant, which prevents reaction gas generated by micro-arc discharge from adhering to a surface of the metal implant.

It is another objective of this invention to provide a method for surface treatment of a metal implant, which prevents reaction gas generated by micro-arc discharge from adhering to a surface of the metal implant.

The present invention provides an electrolyte for surface treatment of a metal implant including 10-30 wt % of a sulfur-containing compound aqueous solution, 3-10 wt % of a phosphorous-containing compound aqueous solution, 0.5-2 wt % of an oxidant aqueous solution, and 0.5-5 wt % of a surfactant aqueous solution, with the rest being water. The concentration of the sulfur-containing compound aqueous solution is 0.1-3 M. The concentration of the phosphorous-containing compound aqueous solution is 0.05-2 M. The concentration of the oxidant aqueous solution is 0.05-1 M. The concentration of the surfactant aqueous solution is 0.05-5 M. As such, reaction gas generated due to micro-arc discharge reaction is prohibited from adhering to a surface of a metal implant, and will not affect formation of a porous oxide layer. Thus, the porous oxide layer can be readily formed on the surface of the metal implant.

In a form shown, the sulfur-containing compound aqueous solution is sulfuric acid aqueous solution or potassium persulfate aqueous solution; the phosphorous-containing compound aqueous solution is phosphoric acid aqueous solution or sodium hypophosphate aqueous solution; the oxidant aqueous solution is hydrogen peroxide aqueous solution or ozone aqueous solution; and the surfactant aqueous solution is an aqueous solution of monoalkyl phosphate, glutamine, polyethylene glycol, potassium N-acyl glutamine or alkyl polyglucoside. As such, the metal implant is provided with improved biocompatibility.

The present invention further provides A method for surface treatment of a metal implant including cleaning a metal implant by sonication, with the metal implant being immersed in a solvent, until dirt adhered on a surface of the metal implant is removed; connecting the cleaned metal implant to an anode and immersing the cleaned metal implant and a cathode in the electrolyte claimed in claim 1; and supplying a voltage of 150-500 V to the anode and the cathode under a temperature of 0 to −10° C. to conduct a micro-arc discharge reaction on the metal implant in the electrolyte, until a porous oxide layer is formed on the surface of the metal implant. As such, the metal implant is able to form an intimate bond with human hard tissues.

In a form shown, the porous oxide layer has a thickness of 0.5-30 μm, a pore diameter of 0.5-15 μm, and a pore deepness of 0.5-3 μm. As such, the metal implant is able to form an intimate bond with human hard tissues.

In the form shown, the micro-arc discharge reaction is conducted for 10-60 minutes on the metal implant in the electrolyte, so as to form the porous oxide layer on the surface of the metal implant. As such, the metal implant is able to form an intimate bond with human hard tissues.

In the form shown, the method for surface treatment of the metal implant further includes immersing the metal implant having the porous oxide layer in a weak acid solution under a temperature of 15-30° C. for 10-30 minutes after the porous oxide layer is formed. The pH value of the weak acid solution is 5.0-7.0. As such, the electrolyte and impurities remained on the surface of the metal implant can be removed.

In the form shown, the weak acid solution is a solution of oxalic acid, citric acid, lactic acid, formic acid or carbonic acid. As such, the weak acid remained on the surface of the metal implant is not harmful to human body.

Since the electrolyte for surface treatment of the metal implant includes appropriate levels of the sulfur-containing compound, the phosphorous-containing compound, the oxidant and the surfactant, reaction gas generated by micro-arc discharge is prevented from adhering to the surface of the metal implant. Thus, formation of the porous oxide layer is not affected by reaction gas, and the porous oxide layer can be readily formed on the surface of the metal implant.

By using the electrolyte in combination with the voltage set at 150-500 V and the temperature set at 0 to −10° C., the method for surface treatment of the metal implant is sufficient to form the porous oxide layer having volcanic vent-like pores on the surface of the implant. The metal implant is thus provided with a rough surface, improving bonding strength between the metal implant and human hard tissues.

The method for surface treatment of metal implant described in the present invention is provided with simple steps, reducing processing time needed for surface treatment. Thus, efficiency of surface treatment of the metal implant is improved.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
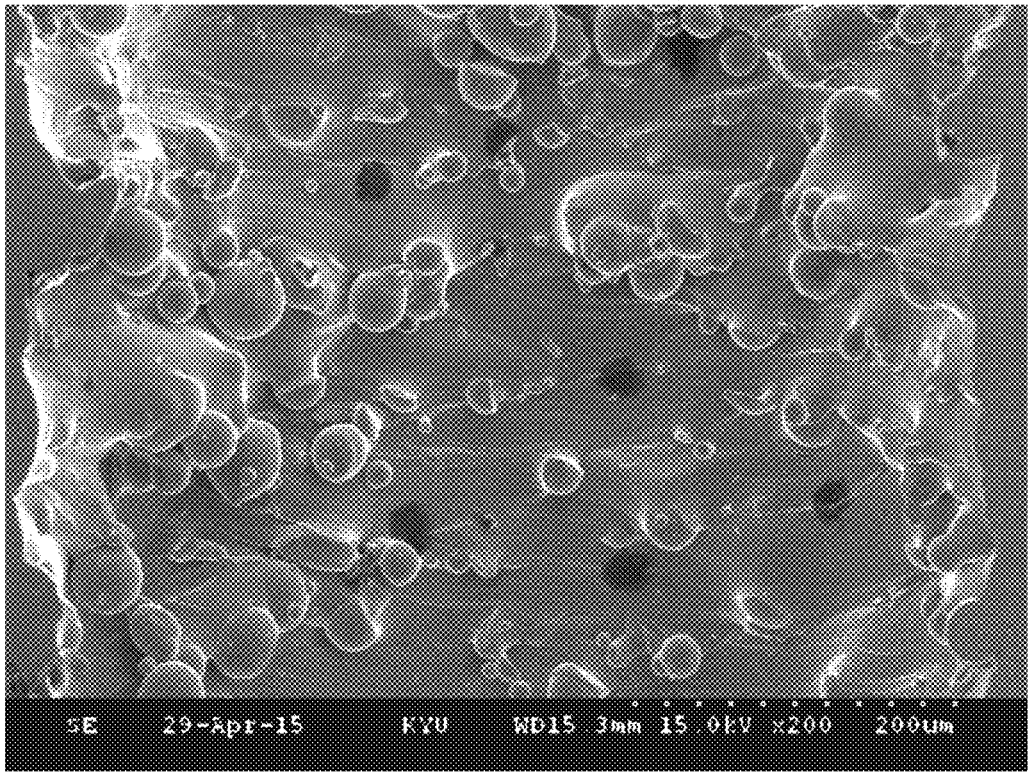
FIG. 1 is an SEM image of a metal implant without surface treatment.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

"Metal implant" described in the present invention is made of a metal or an alloy, and can be used for reconstructing or repairing human teeth, bones or joints. Similarly, the metal implant can also be implanted in other animals. The metal implant can be made of titanium, titanium alloy or a metal material containing titanium element. With the above composition, the metal implant is provided with improved biocompatibility, and is thus suitable for human body. Besides, the metal implant can be originally produced through 3D printing and has apertures or tunnels, such that the metal implant forms an intimate bond with human body.

The present invention provides an electrolyte including a sulfur-containing aqueous solution, a phosphorous-containing aqueous solution, an oxidant aqueous solution and a surfactant aqueous solution. Specifically, the electrolyte can be used in surface treatment of a metal implant.

Providing with more details, the electrolyte includes 10-30 wt % of the sulfur-containing compound aqueous solution, 3-10 wt % of the phosphorous-containing compound aqueous solution, and 0.5-2% of the oxidant aqueous solution. Among the above, the sulfur-containing compound aqueous solution includes a sulfur-containing compound, with its concentration being 0.1-3 M. The sulfur-containing compound can be sulfuric acid, potassium persulfate, etc. The phosphorous-containing compound aqueous solution includes a phosphorous-containing solution, with its concentration being 0.05-2 M. The phosphorous-containing compound can be phosphoric acid, sodium hypophosphate, etc. The oxidant aqueous solution includes an oxidant, with its concentration being 0.05-1 M. The oxidant can be hydrogen peroxide, ozone, etc. However, it is not taken as a limited sense.

In addition, the electrolyte includes 0.5-5 wt % of the surfactant aqueous solution. The concentration of the surfactant aqueous solution is 0.5-5 M, and can be chosen from any type of surfactant aqueous solution, preferably non-toxic to human body. For instance, the surfactant aqueous solution is an aqueous solution of monoalkyl phosphate, glutamine, potassium N-acyl glutamine, alkyl polyglucoside or polyethylene glycol (PEG). Said polyethylene glycol can be PEG-200, PEG-400, PEG-3350, etc.

In the present embodiment, the sulfur-containing compound aqueous solution is a sulfuric acid aqueous solution having a concentration of 2 M, the phosphorous-containing compound aqueous solution is a phosphoric acid aqueous solution having a concentration of 1 M, the oxidant aqueous solution is a hydrogen peroxide aqueous solution having a concentration of 0.1 M, and the surfactant aqueous solution is a PEG-200 aqueous solution having a concentration of 2.5 M. After the sulfur-containing compound aqueous solution, the phosphorous-containing compound aqueous solution, the oxidant aqueous solution and the surfactant aqueous solution are prepared according to the concentrations provided above, the electrolyte is then made by mixing 10-30 wt % of the sulfur-containing compound aqueous solution, 3-10 wt % of the phosphorous-containing compound aqueous solution, 0.5-2 wt % of the oxidant aqueous solution and 0.5-5 wt % of the surfactant aqueous solution, with the rest being water.

By using the electrolyte having these components with particular ratio, when the metal implant is immersed in the electrolyte and supplied with an appropriate voltage, an oxide film is immediately formed on the metal implant. Then, dissociated charged ions repeatedly attack the oxide layer, inducing micro-arc discharge on the metal implant. Arcs or sparks occur on the surface of the metal implant, until the surface of the metal implant melts due to high temperature generated by micro-arc discharge, thus forming a porous oxide layer. Meanwhile, since the electrolyte includes appropriate level of the surfactant with the sulfur-containing compound, the phosphorous-containing compound and the oxidant, even if reaction gas is generated due to micro-arc discharge, it can promptly diffuse and leave the surface of the metal implant, instead of adhering on the surface of the metal implant. Thus, formation of the porous oxide layer will not be affected by reaction gas.

In this way, the sulfur included in the sulfur-containing compound, the phosphorous included in the phosphorous-containing compound and the oxidant can jointly react with the metal particles of the metal implant through electrochemical and plasma reaction, forming the porous oxide layer having ceramic properties. Hence, when the metal implant is implanted in human hard tissues, tissue cells can tightly adhere to the porous oxide layer. The metal implant is thus provided with enhanced biological activity, and can firmly bond with human hard tissues.

The present invention further provides a method for surface treatment of a metal implant, which utilize the electrolyte described above to treat the surface of the metal implant. The method for surface treatment of the metal implant includes cleaning the metal implant by sonication with the metal implant immersed in a solvent, immersing the cleaned metal implant in the electrolyte, and supplying a voltage to form the porous oxide layer.

Specifically, the solvent can be ultrapure water, acetone, alcohol, etc, which is not limited in the present invention. By sonicating the metal implant immersed in the solvent, dirt adhered on the surface of the metal implant can be removed. For instance, said dirt may be processing oil or metallic powders left from previous processes. In this embodiment, the metal implant is sequentially immersed in ultrapure water, acetone, ultrapure water and alcohol with sonication conducted at the same time. Through the cleaning processes, the dirt on the surface of the metal implant can be completely removed, and will not affect the processes thereafter.

The cleaned metal implant is then connected to an anode, followed by immersing a cathode and the implant in the electrolyte described above. A voltage of 150-500 V is supplied under a temperature of 0 to −10° C., such that a micro-arc discharge reaction occurs on the metal implant, forming the porous oxide layer on the surface. In particular, the cathode can be made of platinum, graphite or titanium.

Specifically, when the metal implant is immersed in the electrolyte and the voltage is set at 150-500 V, the oxide film is immediately formed on the surface of the metal implant. The charged ions dissociated in the electrolyte will attack a weak area of the oxide film when the voltage exceeds a critical value. The micro-arc discharge reaction thereby occurs, such that sparks or arcs are gathered on the surface of the metal implant.

At the same time, reaction gas, such as hydrogen gas, is also generated on the surface of the metal implant. In the case that the reaction gas adheres to the surface of the metal implant, the charged ions are prohibited from reaching the surface of the metal implant, thus adversely affecting the efficiency of surface treatment. Since the electrolyte of the present invention is provided with a low surface tension, reaction gas can quickly diffuse and leave the surface of the metal implant, without affecting formation of the porous oxide layer. Furthermore, since this process is carried out under a low temperature, diffusion rate of the reaction gas is further accelerated.

Hence, the micro-arc discharge reaction can repeatedly occur and generates high temperature within a short time, driving the metal implant to react with the electrolyte. The surface of the metal implant melts during this process, forming volcanic vent-like pores. After 10-60 minutes of electrochemical and plasma reactions, the porous oxide layer is provided with nanoscale network shape.

The method for surface treatment of the metal implant further includes washing the metal implant having the porous oxide layer after the porous oxide layer is formed. For instance, the metal implant can be immersed in a pH 5.0-7.0 weak acid solution under a temperature of 15-30° C. for 10-30 minutes to remove the electrolyte and impurities left on the surface. Preferably, the weak acid solution is non-toxic to human body, e.g. oxalic acid, citric acid, lactic acid, formic acid or carbonic acid. By using non-toxic weak acid solutions, even if a few weak acid solution remains on the surface of the implant, it is not harmful to human body.

Moreover, the porous oxide layer is provided with a thickness of 0.5-30 μm, a pore diameter of 0.5-15 μm, and a pore deepness of 0.5-3 μm. Hence, the metal implant can form an enhanced bond with human hard tissue through such a porous oxide layer, further promoting tissue cells to adhere to the metal implant.

According to the method for surface treatment of the metal implant described in the present invention, since the reaction voltage and temperature are set at particular levels corresponding to the metal implant and the electrolyte, formation of the porous oxide layer is protected from being affected by reaction gas. Hence, the method for surface treatment of the metal implant in the present invention produces the porous oxide layer on the surface of the metal implant, enhancing bonding strength between the metal implant and human hard tissue. In this way, the adhesive proteins in cell matrix move towards the porous oxide layer, thus inducing cell adhesion and accelerating osseointegration. Besides, the method for surface treatment of the metal implant is provided with simple steps, eliminating production cost and production time of the metal implant. The efficiency of surface treatment of the metal implant is improved; therefore, the method for surface treatment of the metal implant is suitable for industrial mass production.

For proving that the porous oxide layer with volcanic vent-like pores can be readily formed when the metal implant is treated as described in the present invention, the following experiment is carried out.

In this experiment, the metal implant is a titanium material produced through 3D printing and has small apertures. Before the surface treatment process, an SEM image of an inner wall of the apertures is taken, as shown in FIG. 1. The metal implant is cleaned as described above, and surface treatment is conducted on the metal implant using an electrolyte without the surfactant aqueous solution (Group A1) or the electrolyte including the surfactant aqueous solution (Group A2) to form the porous oxide layer. The metal implant is then washed using the weak acid solution, before observing the inner wall of the apertures using SEM.

The experiment uses sulfuric acid aqueous solution, phosphoric aqueous solution, hydrogen peroxide aqueous solution and PEG-200 aqueous solution as the sulfur-containing compound aqueous solution, the phosphorous-containing compound aqueous solution, the oxidant aqueous solution and the surfactant aqueous solution. In addition, oxalic acid solution is chosen as the weak acid solution. The concentrations of each component in the electrolytes of Group A1 and A2 are listed in Table 1, and the electrolytes of Group A1 and A2 are made by mixing these components according to the weight percentages described above. The SEM images of Group A1 are shown as FIGS. 2*a* and 2*b*, and the SEM images of Group A2 are shown as FIGS. 3*a* and 3*b*.

TABLE 1 the electrolyte composition and concentration of Group A1 and A2

| electrolyte components | $[H_2SO_4]$ | $[H_3PO_4]$ | $[H_2O_2]$ | [PEG-200] |
|---|---|---|---|---|
| Group A1 | 2M | 1M | 0.1M | 0 |
| Group A2 | 2M | 1M | 0.1M | 2.5M |

Figure 2A:
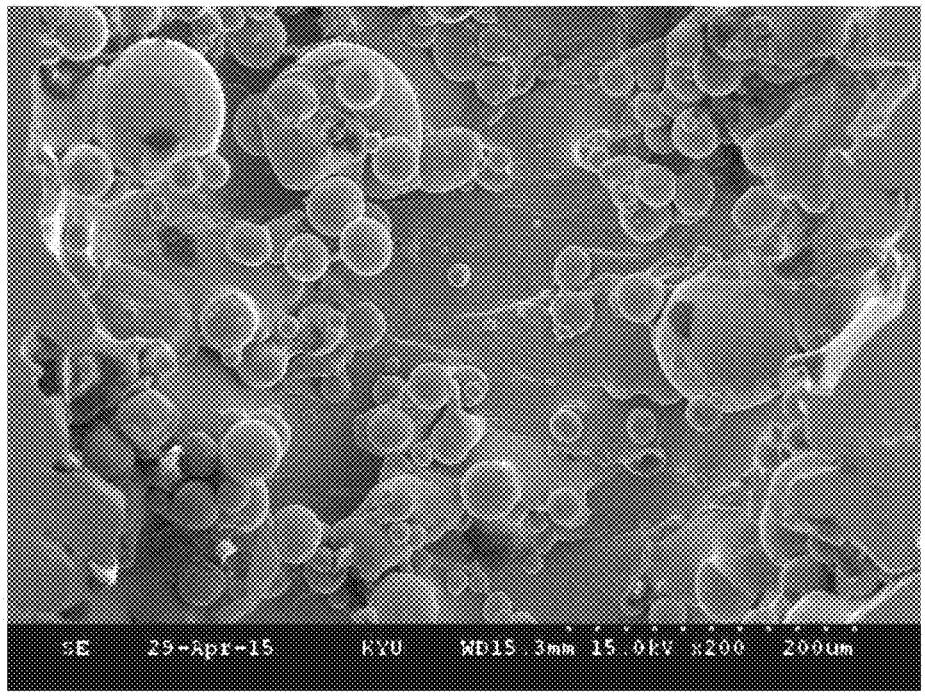
FIG. 2*a* is an SEM image of a metal implant of Group A1.
Figure 2B:
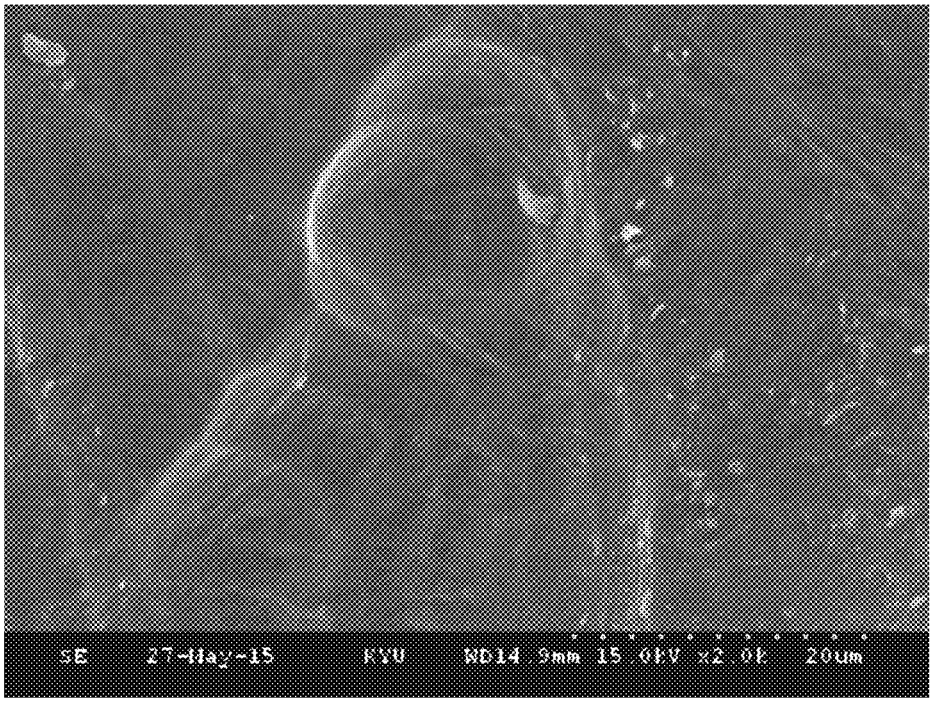
FIG. 2*b* is another SEM image of the metal implant of Group A1.
Figure 3A:
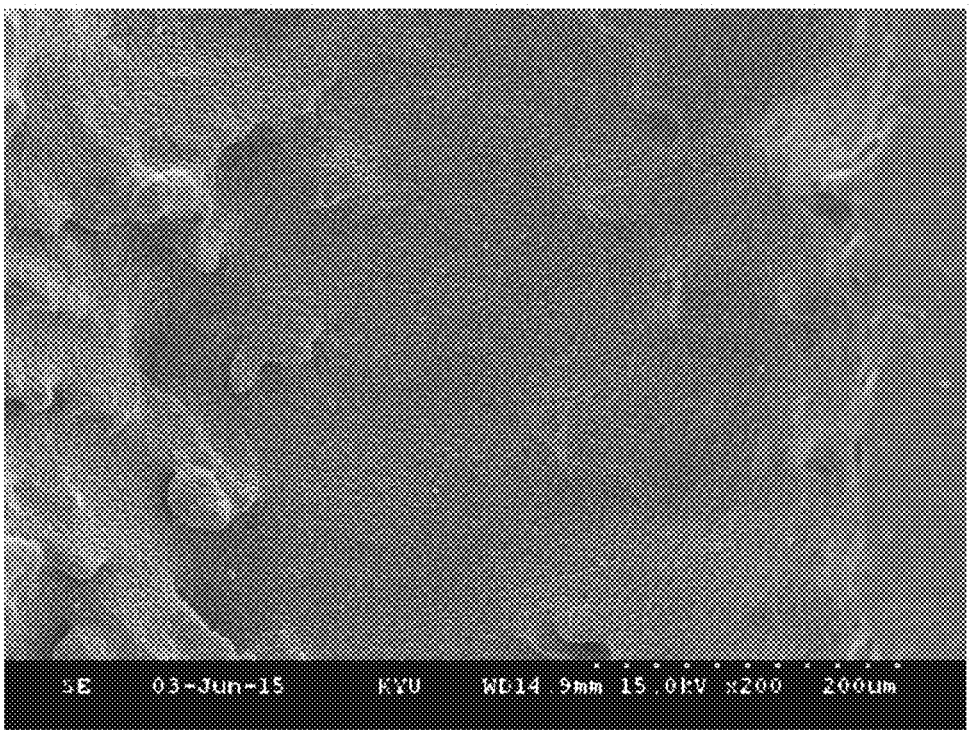
FIG. 3*a* is an SEM image of a metal implant of Group A2.
Figure 3B:
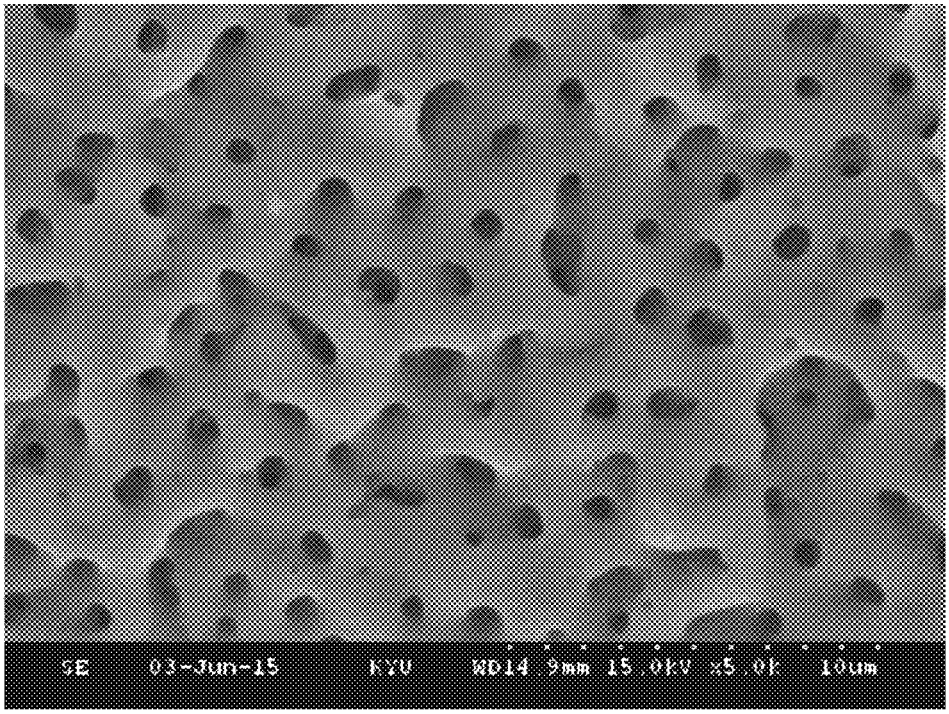
FIG. 3*b* is another SEM image of the metal implant of Group A2.

With references to FIGS. 2*a* and 2*b*, since the electrolyte does not include the surfactant aqueous solution, the reaction gas tends to adhere to the surface of the metal implant. Thus, the electrolyte is prohibited from flowing into the apertures, and the porous oxide layer cannot be formed inside the apertures. In comparison, as shown in FIGS. 3*a* and 3*b*, when the surfactant aqueous solution is included in the electrolyte, reaction gas is promoted to leave the surface of the metal implant without affecting formation of the porous oxide layer. Thus, the porous oxide layer having volcanic vent-like pores is readily formed.

In summary, since the electrolyte for surface treatment of the metal implant includes appropriate levels of the sulfur-containing compound, the phosphorous-containing compound, the oxidant and the surfactant, reaction gas generated by micro-arc discharge is prevented from adhering to the surface of the metal implant. Thus, formation of the porous oxide layer is not affected by reaction gas, and the porous oxide layer can be readily formed on the surface of the metal implant.

Moreover, by using non-toxic components, i.e. using sulfuric acid or potassium persulfate as the sulfur-containing compound, using phosphoric acid or sodium hypophosphate as the phosphorous-containing compound, using hydrogen peroxide or ozone as the oxidant, and using monoalkyl phosphate, glutamine, polyethylene glycol, potassium N-acyl glutamine or alkyl polyglucoside as the surfactant, the electrolyte for surface treatment of the metal implant is not harmful to human body, thus providing the metal implant with excellent biocompatibility.

Furthermore, by using the electrolyte in combination with the voltage set at 150-500 V and the temperature set at 0 to −10° C., the method for surface treatment of the metal implant is sufficient to form the porous oxide layer having volcanic vent-like pores on the surface of the implant. The metal implant is thus provided with a rough surface, improving bonding strength between the metal implant and human hard tissues.

Besides, the method for surface treatment of metal implant described in the present invention is provided with simple steps, reducing processing time needed for surface treatment. Thus, efficiency of surface treatment of the metal implant is improved.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A method for surface treatment of a metal implant, comprising:

cleaning a metal implant by sonication, with the metal implant being immersed in a solvent, until dirt adhered on a surface of the metal implant is removed;

connecting the cleaned metal implant to an anode and immersing the cleaned metal implant and a cathode in an electrolyte; and supplying a voltage of 150-500 V to the anode and the cathode under a temperature of 0 to −10° C. to conduct a micro-arc discharge reaction on the metal implant in the electrolyte, until a porous oxide layer is formed on the surface of the metal implant, wherein the electrolyte comprises:

10-30 wt % of a sulfur-containing compound aqueous solution, 3-10 wt % of a phosphorous-containing compound aqueous solution, 0.5-2 wt % of an oxidant aqueous solution, and 0.5-5 wt % of a surfactant aqueous solution, with the rest being water;

wherein the sulfur-containing compound aqueous solution has a concentration of 0.1-3 M, the phosphorous-containing compound aqueous solution has a concentration of 0.05-2 M, the oxidant aqueous solution has a concentration of 0.05-1 M, and the surfactant aqueous solution has a concentration of 0.05-5 M.

2. The method for surface treatment of the metal implant as claimed in claim 1, wherein the porous oxide layer has a thickness of 0.5-30 μm, a pore diameter of 0.5-15 μm, and a pore deepness of 0.5-3 μm.

3. The method for surface treatment of the metal implant as claimed in claim 1, further comprising conducting the micro-arc discharge reaction for 10-60 minutes on the metal implant in the electrolyte, to form the porous oxide layer on the surface of the metal implant.

4. The method for surface treatment of the metal implant as claimed in claim 1, further comprising immersing the metal implant having the porous oxide layer in a weak acid solution under a temperature of 15-30° C. for 10-30 minutes after the porous oxide layer is formed, wherein the weak acid solution has a pH value of 5.0-7.0.

5. The method for surface treatment of the metal implant as claimed in claim 4, wherein the weak acid solution is a solution of oxalic acid, citric acid, lactic acid, formic acid or carbonic acid.

* * * * *